US009458654B2

(12) United States Patent
Palsson et al.

(10) Patent No.: US 9,458,654 B2
(45) Date of Patent: Oct. 4, 2016

(54) WHEEL CARRIAGE

(75) Inventors: Ingemar Palsson, Lund (SE); Sven Asbo, Allerum (SE); Erik Backman, Landskrona (SE)

(73) Assignee: ASSA ABLOY Entrance Systems AB, Landskrona (SE)

( * ) Notice: Subject to any disclaimer, the term of this patent is extended or adjusted under 35 U.S.C. 154(b) by 229 days.

(21) Appl. No.: 13/808,879

(22) PCT Filed: Jun. 8, 2011

(86) PCT No.: PCT/EP2011/059521

§ 371 (c)(1),
(2), (4) Date: Mar. 27, 2013

(87) PCT Pub. No.: WO2012/004078

PCT Pub. Date: Jan. 12, 2012

(65) Prior Publication Data

US 2013/0205542 A1 Aug. 15, 2013

Related U.S. Application Data

(60) Provisional application No. 61/412,269, filed on Nov. 10, 2010.

(30) Foreign Application Priority Data

Jul. 7, 2010 (SE) ..... 1050745

(51) Int. Cl.
*E05D 15/06* (2006.01)

(52) U.S. Cl.
CPC ..... *E05D 15/0634* (2013.01); *E05Y 2201/688* (2013.01); *E05Y 2600/52* (2013.01); *E05Y 2900/132* (2013.01); *Y10T 16/3825* (2015.01); *Y10T 29/4973* (2015.01)

(58) Field of Classification Search
CPC ..... Y10T 16/354; Y10T 16/381; Y10T 16/3816; Y10T 16/3834; Y10T 16/384; Y10T 16/3825; E05D 15/06; E05D 15/063; E05D 15/0634; E05D 15/0604; E05D 15/0621; E05D 15/0626
USPC ..... 16/87.4 R, 97, 99, 105, 107, 102; 49/425, 405
See application file for complete search history.

(56) References Cited

U.S. PATENT DOCUMENTS 1,066,236 A 7/1913 Wells
1,090,306 A * 3/1914 Hoffman ..... 16/105

(Continued)

FOREIGN PATENT DOCUMENTS

AU 779340 1/2005
CN 2698938 5/2005

(Continued)

OTHER PUBLICATIONS

Official Action (with English translation) for Chinese Patent Application No. 201180033731.0 dated Aug. 5, 2014, 22 pages.

(Continued)

*Primary Examiner* — Emily Morgan
(74) *Attorney, Agent, or Firm* — Sheridan Ross P.C.

(57) ABSTRACT

The present invention relates to the field of sliding door systems. The invention relates to a wheel carriage8300) for a sliding door resting in sliding track (106), comprising wheel connection means (340) adapted to removably connect a wheel shaft (331) at two connection points (341) positioned on each side of a wheel (330). The invention also relates to a method for exchanging the wheels (330) of a wheel carriage (300), by lowering a door panel and replacing the wheels (330), while the wheel carriage (300) is resting in the sliding track (106).

13 Claims, 9 Drawing Sheets

(56) References Cited

U.S. PATENT DOCUMENTS

| | | | | |
|---|---|---|---|---|
| 1,930,379 | A * | 10/1933 | Bennett | 16/97 |
| 2,940,113 | A | 6/1960 | Riser | |
| 2,999,267 | A | 9/1961 | Sterling et al. | |
| 3,041,657 | A | 7/1962 | McNinch | |
| 3,057,005 | A * | 10/1962 | Dishaw | 16/105 |
| 3,208,109 | A * | 9/1965 | Buck, Jr. | 49/425 |
| 3,670,357 | A | 6/1972 | Steigerwald | |
| 4,483,045 | A | 11/1984 | Shelton et al. | |
| 4,633,615 | A | 1/1987 | Moose | |
| 4,899,493 | A | 2/1990 | Baumgarten | |
| 5,018,306 | A * | 5/1991 | Prevot | 49/425 |
| 5,035,025 | A | 7/1991 | Morris et al. | |
| 5,598,666 | A * | 2/1997 | Kurth | A47K 3/34 4/557 |
| 5,950,279 | A * | 9/1999 | Chaput | 16/105 |
| 6,021,547 | A | 2/2000 | Stagoll | |
| 6,185,784 | B1 | 2/2001 | Gamperle | |
| 6,209,171 | B1 * | 4/2001 | Pelletier et al. | 16/97 |
| 6,321,413 | B1 | 11/2001 | Zingg | |
| 6,698,138 | B1 * | 3/2004 | Lin | E05D 15/0639 16/105 |
| 2002/0007760 | A1 | 1/2002 | Brandt | |
| 2005/0011041 | A1 | 1/2005 | Ness | |
| 2007/0017065 | A1 | 1/2007 | Hutnik et al. | |
| 2007/0130725 | A1 | 6/2007 | Ness | |
| 2009/0019665 | A1 | 1/2009 | Kelley | |
| 2009/0077766 | A1 * | 3/2009 | Proctor et al. | 16/97 |
| 2010/0037427 | A1 * | 2/2010 | Burgess et al. | 16/97 |
| 2013/0205541 | A1 * | 8/2013 | Backman et al. | 16/102 |

FOREIGN PATENT DOCUMENTS

| | | |
|---|---|---|
| CN | 2767594 | 3/2006 |
| CN | 101248243 | 8/2008 |
| CN | 201202342 | 3/2009 |
| DE | 564572 | 11/1932 |
| DE | 1559927 B1 | 3/1970 |
| DE | 202006007326 | 9/2006 |
| EP | 0563015 | 9/1993 |
| GB | 526287 | 9/1940 |
| GB | 990057 | 4/1965 |
| GB | 2142365 | 1/1985 |
| JP | H08-82150 | 3/1996 |
| JP | 2004-232412 | 8/2004 |
| WO | WO 2009081240 | 7/2009 |
| WO | WO 2010/019692 | 2/2010 |

OTHER PUBLICATIONS

Official Action (with English translation) for Chinese Patent Application No. 201180033732.5 dated Jul. 15, 2014, 12 pages.

Notice of Allowance for U.S. Appl. No. 13/808,862, mailed Sep. 30, 2014, 8 pages.

Official Action for U.S. Appl. No. 13/808,862, mailed May 27, 2014, 6 pages.

International Search Report prepared by the European Patent Office on Sep. 14, 2011, for International Application No. PCT/EP2011/059521.

Written Report prepared by the European Patent Office on Sep. 14, 2011, for International Application No. PCT/EP2011/059521.

International Search Report prepared by the European Patent Office on Sep. 21, 2011, for International Application No. PCT/EP2011/059512, 4 pages.

Written Opinion prepared by the European Patent Office on Sep. 21, 2011, for International Application No. PCT/EP2011/059512, 5 pages.

U.S. Appl. No. 13/808,862, filed Jan. 7, 2013, Palsson et al.

Official Action for European Patent Application No. 11723985.5, dated Nov. 13, 2014, 5 pages.

International Preliminary Report on Patentability for International Application No. PCT/EP2011/059521, dated Jan. 8, 2013, 6 pages.

Search Report (English translation) for Chinese Patent Application No. 201180033731.0 dated Jul. 28, 2014, 2 pages.

Official Action for European Patent Application No. 11725910.1, dated Nov. 14, 2014, 4 pages.

Official Action for European Patent Application No. 11723985.5, dated Jul. 2, 2015, 5 pages.

* cited by examiner

WHEEL CARRIAGE

CROSS REFERENCE TO RELATED APPLICATIONS

This application is a national stage application under 35 U.S.C. 371 and claims the benefit of PCT Application No. PCT/EP2011/059521 having an international filing date of Jun. 8, 2011, which designated the United States, which PCT application claimed the benefit of U.S. Provisional Application No. 61/412,269 filed Nov. 10, 2010, and Swedish Patent Application No. 1050745-7 filed Jul. 7, 2010, the disclosures of each of which are incorporated herein by reference.

TECHNICAL FIELD

The present invention relates to the field of sliding doors and more particularly to a wheel carriage and a method for exchanging the wheels of a wheel carriage.

BACKGROUND

Automatic doors e.g. sliding doors or revolving doors are commonly used e.g. in commercial, health care and residential applications.

A sliding door system typically comprises door panels attached to wheel carriages running in a sliding track. Due to the high number of repetitions of opening and closing and the considerable weight of the door panels, the wear on the wheels and the wheel carriage in such an application is considerable.

Therefore, metal wheels are often used in this type of applications. However, metal wheels may cause noise when running in the track. An alternative is to use plastic wheels, which are cheaper. A problem with using plastic wheels is that they need to be replaced more frequently and that the procedure of replacing the wheels is complicated and often implies readjustment of the complete door panel. Therefore, wheel replacement typically needs to be assisted by professional staff.

Different doors put different requirements on the wheels and the wheel carriage, due to e.g. varying weight. The average weight of a door panel may be about 60 kg. However, in some application door panels weighing 200-300 kg are used. This may cause problems such that the door is not sliding smoothly in the track or that the wheels are worn out very quickly.

Another problem of sliding door systems is that the height adjustment is complicated and thus often inaccurate. Height adjustment typically needs to be performed each time the door has been removed from the sliding track e.g. in connection to wheel exchange.

Hence, it is a general problem that the wheels of a sliding door system are worn out and that the existing methods for exchanging the wheel of a wheel carriage in a sliding door system are inflexible, expensive and time consuming. Therefore, finding an improved wheel carriage, which mitigates or alleviates the above-mentioned drawbacks, would be most welcome.

SUMMARY OF THE INVENTION

With the above description in mind, then, an aspect of the present invention is to provide a method and a wheel carriage, which seeks to mitigate, alleviate, or eliminate one or more of the above-identified deficiencies in the art and disadvantages singly or in any combination.

According to one aspect of the invention, it provides for an improved wheel carriage, wherein the wheels can be easily exchanged.

More specifically the invention relates to a wheel carriage for a sliding door resting in a sliding track, comprising:

- a wheel holder comprising at least two wheel connection means, and
- a door carrier, movably connected to the wheel holder and adapted to be attached to the upper part of a door panel, wherein each wheel connection means comprises two connection points, adapted to be connected to opposite sides of a wheel.

The invention also relates to a wheel carriage, further comprising:

- height adjustment means adapted to adjust the distance between the wheel holder and the door carrier in a vertical direction to such an extent that the wheels are removable from the wheel holder, when the wheel carriage is arranged in the sliding track.

The invention also relates to a wheel carriage, wherein the height adjustment means are adapted to increase the distance between the wheel holder and the door carrier to such an extent that the bottom of the door panel rests at a foundation when the wheel carriage is arranged in the sliding track.

The invention also relates to a wheel carriage, wherein the height adjustment means comprises an excenter cam rotatable around an axis running through the wheel holder, and wherein the excenter cam is in contact with the door carrier, such that rotation of the excenter cam increases the distance between the wheel holder and the door carrier.

The invention also relates to a wheel carriage, wherein the wheels are fastened to the wheel holder by the gravitation force of a door panel attached to the door carrier.

The invention also relates to a wheel carriage, wherein each wheel connection means comprises two recesses in the lower side of the wheel holder, wherein the recesses are adapted receive a wheel shaft.

The invention also relates to a wheel carriage, wherein each shortside of the wheel holder has an aperture, wherein the aperture is dimensioned such the wheel is removable through the shortside, when the wheel carriage is positioned in the sliding track.

The invention also relates to a wheel carriage, wherein the wheel holder has a boxlike shape.

The invention also relates to a wheel carriage, wherein the door carrier is integrated in a door panel.

The invention also relates to a wheel carriage, wherein the excenter cam comprises a first key grip.

The invention also relates to a wheel carriage further comprising:

- a fixation screw adapted to fixate the door in a vertical position, wherein the fixation screw comprises a second key grip, wherein the second key grip is equal to the first key grip.

The invention also relates to a method for exchanging wheels of a wheel carriage resting in a sliding track, said wheel carriage comprising one wheel holder, at least two wheels and one door carrier; wherein the wheel holder comprises at least two wheel connection means, each comprising two connection points connected to opposite sides of one of the wheels and wherein the door carrier is attached to a door panel, comprising the steps:

- lowering the door panel in a vertical direction to such an extent that the wheels are removable from the wheel holder, replacing at least one wheel and elevating the door panel so that the weight of the door panel rests in the sliding track.

The invention also relates to a method for exchanging wheels, wherein the step of lowering the door panel further comprises:

lowering the door panel to such an extent that the bottom of the door panel rests at a foundation, when the wheel carriage is still arranged in the sliding track.

The invention also relates to a method for exchanging wheels wherein the step of lowering the door panel further comprises:

rotating an excenter cam around an axis running through the wheel holder, wherein the excenter cam is in contact with the door carrier, such that rotation of the excenter cam forces the distance between the wheel holder and the door carrier to increase.

The invention also relates to a method for exchanging wheels, wherein the step of replacing one wheel comprises unfastening the at least one wheel from the wheel holder by increasing the distance between the wheel holder and the door carrier.

The invention also relates to a method for exchanging wheels, wherein the step of replacing one wheel comprises:

fastening at least one wheel to the wheel holder by decreasing the distance between the wheel holder and the door carrier.

The invention also relates to a method for exchanging wheels, wherein the wheels are fastened in recesses in the lower side of the wheel holder.

The invention also relates to a method for exchanging wheels, wherein the step of replacing at least one wheel further comprises the step:

replacing the wheels through an aperture in the shortside of the wheel holder.

The invention also relates to a method for exchanging wheels, further comprising the step:

fixating the door in a vertical position using a fixation screw.

The invention also relates to a method for exchanging wheels, further comprising:

using the same tool for the fixation screw and for the height adjustment.

The invention is defined by the independent claims. Embodiments are set forth by the dependent claims and by the following description and the drawings.

According to the invention, an improved wheel carriage is achieved e.g. by fixating a wheel shaft to the wheel carriage using a removable connection at two points. Today, the wheels in a sliding door system are typically bolted onto a wheel holder. The wheel holder is a flat metal sheet. The thickness and the material have to be adapted to bear the weight of the sliding door panels. Bolting typically introduces an additional step in the manufacturing process of the wheel carriage. This step is avoided by the present invention.

Another effect of one aspect of the invention is that it enables a flexible wheel connection as it e.g. uses the gravitation force of the door panels to fixate the wheel shaft.

Another effect of the invention is that the shape of the wheel carriage provides for a stable construction, which implies that a thinner metal sheet can be used. Hence, manufacturing is simplified and material cost is reduced.

Another effect of the invention is that the pressure is distributed evenly on the wheels, e.g. due to the doublesided connection to the wheels.

Another effect of the invention is that it enables facilitated height adjustment of a sliding door.

BRIEF DESCRIPTION OF THE DRAWINGS

Further objects and features, of the present invention will appear from the following detailed description of embodiments of the invention, wherein the embodiments will be described in more detail with reference to the accompanying drawings, in which.

It should be added that the following description of the embodiments is for illustration purposes only and should not be interpreted as limiting the invention exclusively to these embodiments/aspects.

DETAILED DESCRIPTION

Embodiments of the present invention relate, in general, to the field of automatic sliding doors and, in particularly, to a wheel carriage of such a system. The invention also relates to a method for exchanging the wheels of such a wheel carriage. One example of such a system is Besam™ Sliding Door Operator UniSlide.

Embodiments of the present invention will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference signs refer to like elements throughout.

Figure 1:
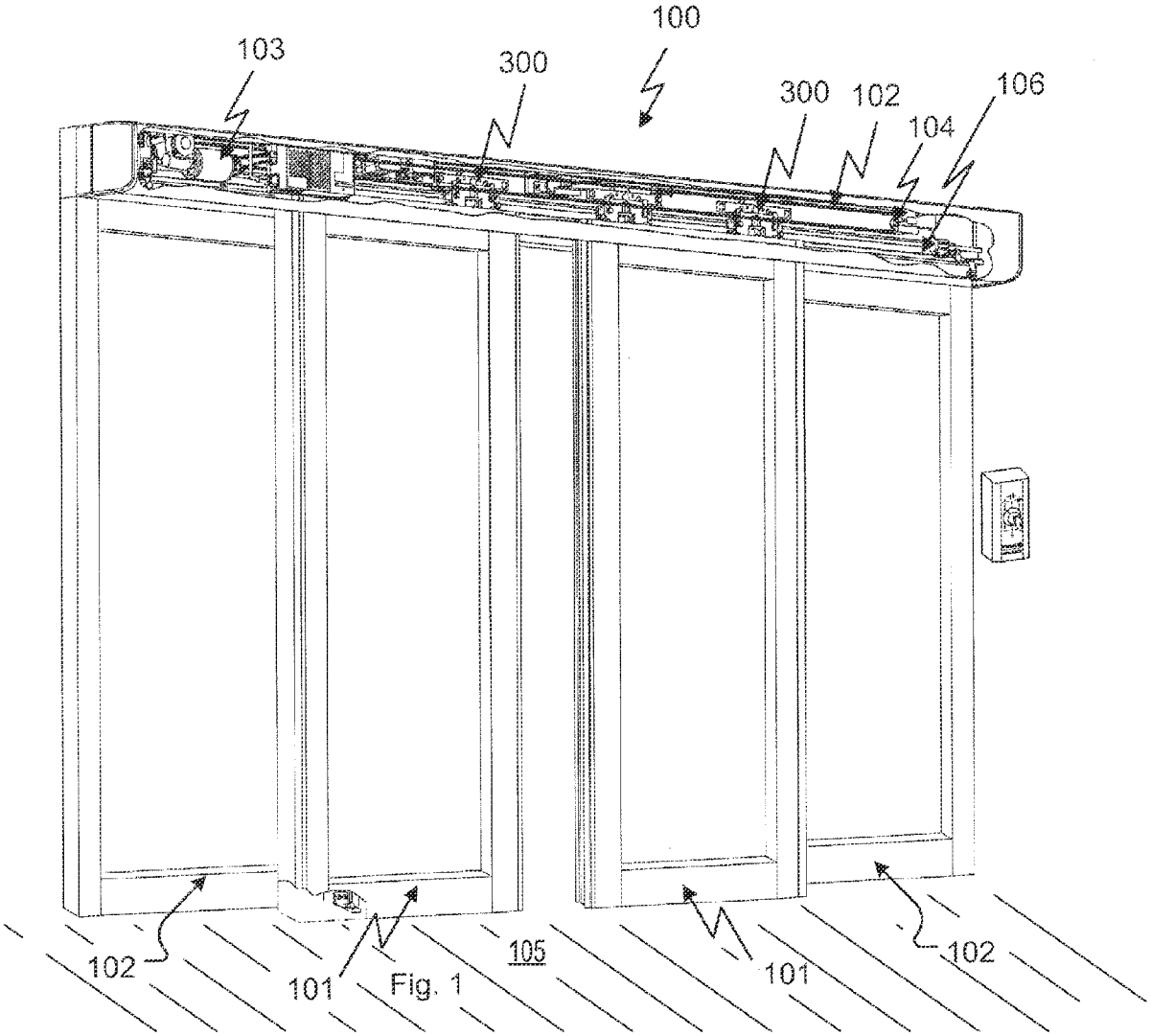
FIG. 1 illustrates a sliding door system.

FIG. 1 shows an overview of a sliding door system 100. The sliding door system 100 comprises two door panels 101 and two surrounding walls 102. The door panels 101 are connected to wheel carriages 300 and hangs in a sliding track 106. The guiding at the bottom is carried out by means of floor guides (not shown).

The sliding door system 100 further comprises drive means comprising a tooth belt 102, a drive wheel 104 and an electrical motor 103. The electrical motor 103 transmits movement to the door panels 101 by the drive means. The tooth belt 102 is connected to the wheel carriages 300 attached to the upper side of the door panels 101.

Figure 2A:
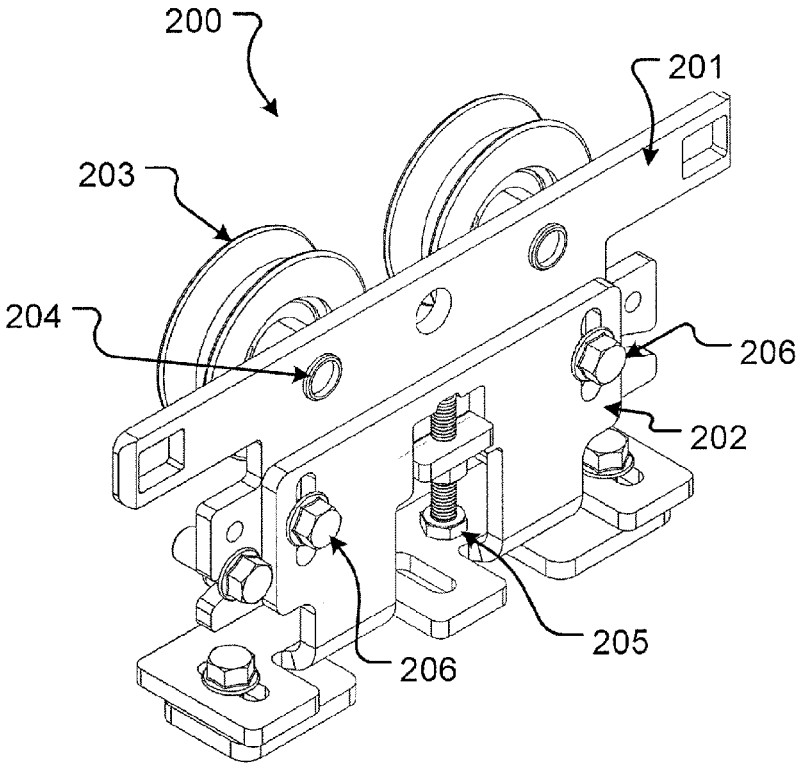
(PRIOR ART) Fig. 2a
FIG. 2*a*-2*b* illustrates a wheel carriage according to prior art.
Figure 2B:
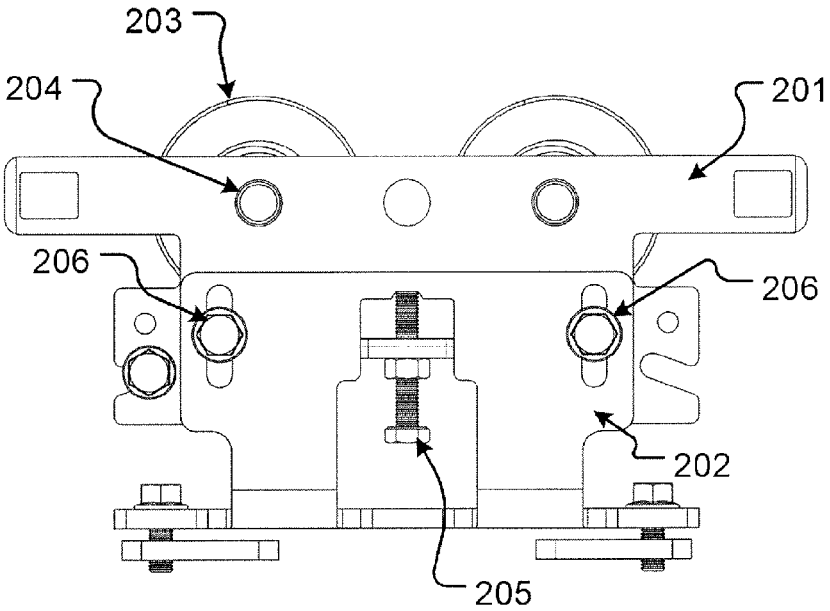
(PRIOR ART) Fig. 2b

FIG. 2*a-b* shows a wheel carriage 200 according to prior art. The wheel carriage 200 comprises a wheel holder 201, a door carrier 202, a pair of wheels 203, bolts 204, height adjustment arrangement means 205 and locking screws 206. The door carrier 202 is adapted to be attached to the upper side of a door blade 101. The wheel holder 201 holds the wheels 203 adapted to run in the sliding track 106. The wheel holder 201 is slidably attached to the door carrier 202, and locked in a fixed position with the locking screws 206. According to prior art the wheel shafts holding the wheels are bolted, with bolts 204, to the wheel holder 201, which has a planar shape.

In order to exchange the wheels 203 of the wheel carriage 200, when they are worn out or broken, the door needs to be demounted. The entire wheel holder 201 is then removed from the door bracket 202. The entire wheel holder 201 is then exchanged and the door 101 is finally remounted and height adjusted.

A wheel carriage will now be described with references made to the FIG. 3-7.

Figure 3A:
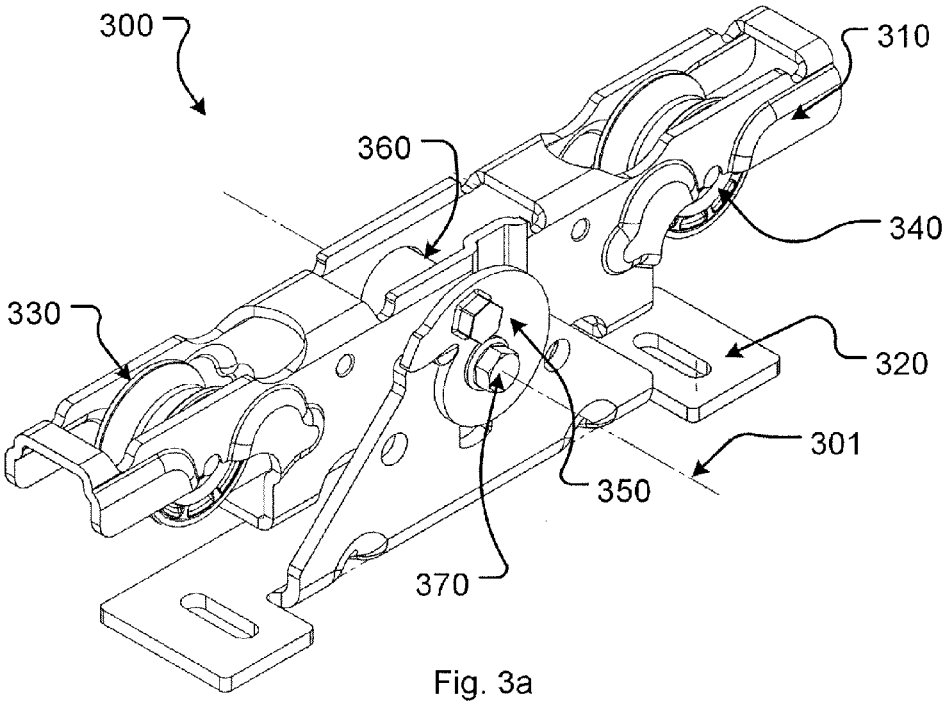
FIG. 3*a-b* illustrates a wheel carriage.
Figure 3B:
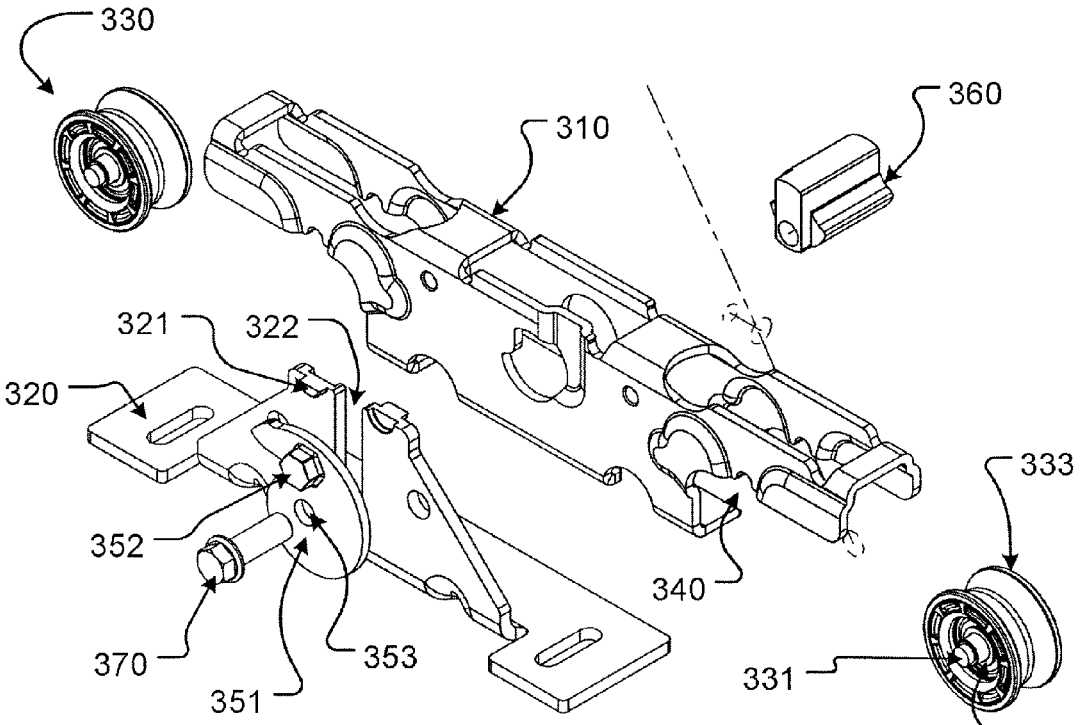

FIG. 3*a-b* illustrates a wheel carriage 300. The wheel carriage 300 will now be described in more detail in particular refering to FIGS. 3*a* and 3*b*. The wheel carriage 300 comprises a door carrier 320, wheels 330, height adjustment means 350, a centre shaft 360, a fixation screw 370 and a wheel holder 310, comprising two wheel connection means 340.

Figure 4A:
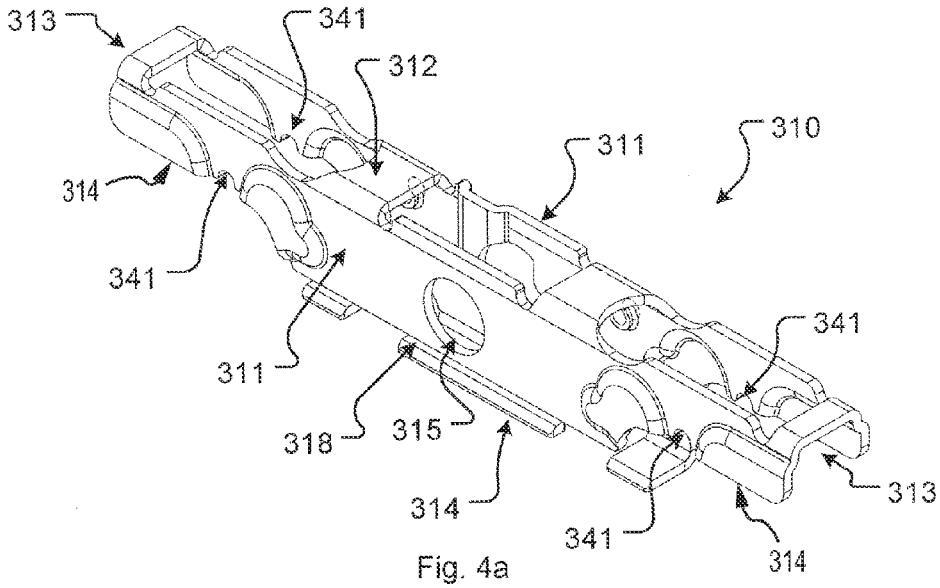
FIGS. 4*a-c* illustrates a wheel holder.
Figure 4B:
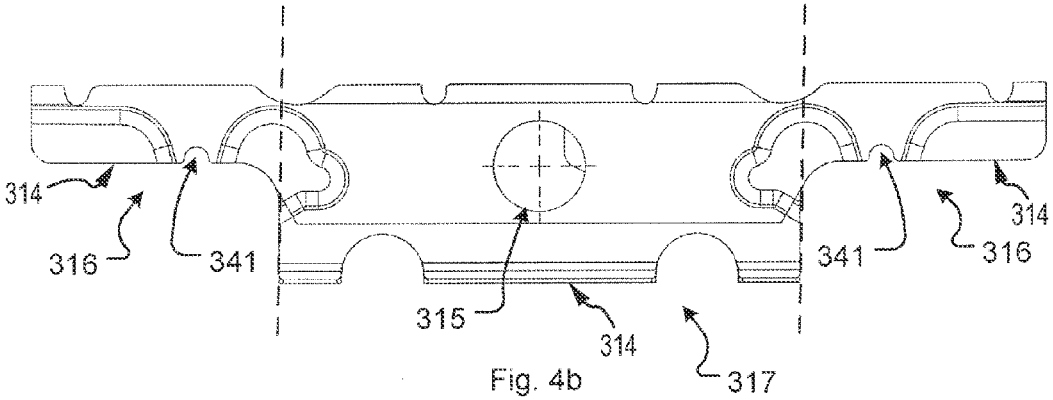
Figure 4C:
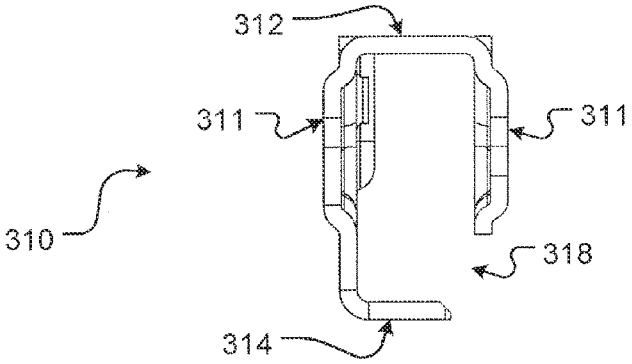

The wheel holder 310, disclosed in detail in FIGS. 4*a-c*, is an arrangement for holding the wheels 330. FIG. 4*a* illustrates the wheel holder 310 in more detail. The wheel holder 310 is made from a metal sheet. The metal sheet is bent into a hollow boxlike shape. The wheel holder 310 has an oblong shape comprising two long sides 311, an upper side 312, two short sides 313 and a lower side 314. An upper edge of each long side 311 is attached along each side of the upper side 312 of the wheel holder 310. One of the long sides 311 has an opening 318 adapted to receive the sliding track 106, when the wheel carriage 300 is positioned in a sliding track 106. The lower side 314 and the opening 318 stretch all the way from one short side 313 to the other. See also FIG. 4*c* showing the wheel holder 310 seen from the short side 313.

FIG. 4*b* shows the wheel holder seen from the long side. The long sides 311 of the wheel holder 310 have one tapering part 316 at each end and a wider part 317 at the middle. The wider part 317 stretches below the sliding track 106, when the wheel carriage 300 is positioned in the sliding track 106. Hence, the wider part of the wheel holder has a C-like shape seen from the short side 313. Each long side 311 further comprises an aperture 315 for receiving a centre shaft 360. The aperture 315 is positioned at the middle portion of each long side 311.

The short side 313 of the wheel holder 310 is open, as disclosed in FIG. 4*c*. The lower side 314 of the wheel holder is also partly open. In particular, the end parts of the lower side 314 are open to make room for the wheels 330. Thereby, the long sides 311 and the upper side 312 form a reversed U-shape, at the tapering part 316 of the wheel holder 310, when seen from the short side 313. The short sides 313 may also be partly solid with an aperture big enough to enable removal of a wheel 330 trough the short side 313, while the wheel carriage 300 is positioned in a sliding track 106.

The wheels 330 comprise a wheel shaft 331, attached by a ball bearing 332, and a rim 333, see FIG. 3*b*. A plastic tire may be attached to the rim 333. The wheel holder 310 comprises two wheel connection means 340 for holding the wheels 330. Each wheel connection means 340 comprises two connection points 341 positioned opposite each other at the lower side of each long side 311, see FIG. 4*a*. The connection points are positioned on opposite sides of the wheel 330, when the wheel 330 is connected. The connection points are recesses 341 corresponding to the shape of the wheel shaft 331. The recesses 341 constitute two semicircles at the lower edges of each long side 311, see FIG. 4*b*. Each recess 341 is adapted to receive one end of a wheel shaft 331. Hence, the width (d) of each recess 341 corresponds to the width of the wheel shaft wheel shaft 331. The wheel shaft 331 is locked in its position by the weight of the door panel 101. The U-shape of the tapering part of the wheel holder 316 enables insertion and removal of a wheel 330, through the short side 313 of the wheel holder 310, when the wheel carriage 300 is located in the sliding track 106.

According to one aspect of the invention, the wheel shafts 331 may be welded to the wheel connection means, in order to prevent exchange.

The door carrier 320 is a metal sheet bent about 90 degrees, thereby forming an L-shape, when seen from the side, see FIG. 3*b*. The horizontal part of the L is adapted to be connected to the upper side of a door panel 101. The door carrier 320 may also be integrated in the door panel 101. The vertical part of the L has attachment means 322 for slidably attaching the door carrier 320 to the wheel holder 310. The attachment means 322 is a vertical slot 322 in the vertical part of the door carrier 320, stretching downwards from the upper side the door carrier 320. The outer portions of the metal sheet are not bent in an L-shape, thereby forming an extension to the horizontal part in the opposite direction. The door carrier further comprises two knobs 321 positioned on each side of the vertical part. The knobs 321 are positioned at the upper edge of the door carrier 320. The knobs 321 are adapted to bear against the height adjustment means 350, when adjusting the height of the door.

The height adjustment means 350 comprises an excenter cam disc 351 with a key grip 352. The excenter cam disc 351 has a central aperture 353 positioned such that the distance from the center of the central aperture 353 to the edge of the excenter cam disc 351 varies.

At the mounted wheel carriage 300, see FIG. 3*a*, the vertical part of the door carrier 320 is placed in contact with one long side 311 of the wheel holder 310, such that the horizontal part of the door carrier 320 is positioned under the wheel holder 310. The excenter cam disc 351 is placed on the door carrier, such that the central aperture 315 overlaps the vertical slot 322. The centre shaft 360 is positioned in the aperture 315 of the wheel holder 310 and in the vertical slot 322 of the door carrier 320. Thereby, the centre shaft 360 is fixated to the wheel holder 310. The part of the centre shaft 360 running through the vertical slot has a width corresponding to the width of the vertical slot 322. Thereby, the door carrier 320 is slidably attached to the wheel holder 310, in a vertical direction. A screw 306 runs through the central aperture of the excenter cam disc 351 and through the centre shaft 360 and fixates the excenter cam disc 351 and the door carrier 320 in a wished position in relation to the centre shaft 360.

Figure 5A:
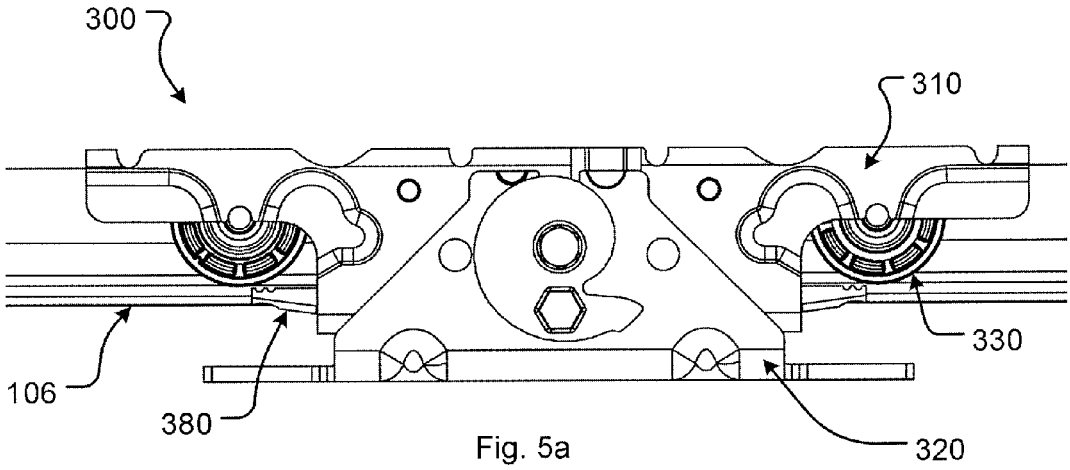
FIGS. 5*a-c* illustrates a wheel carriage resting in a sliding track.
Figure 5B:
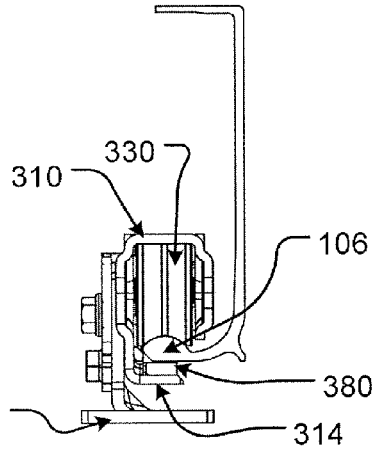
Figure 5C:
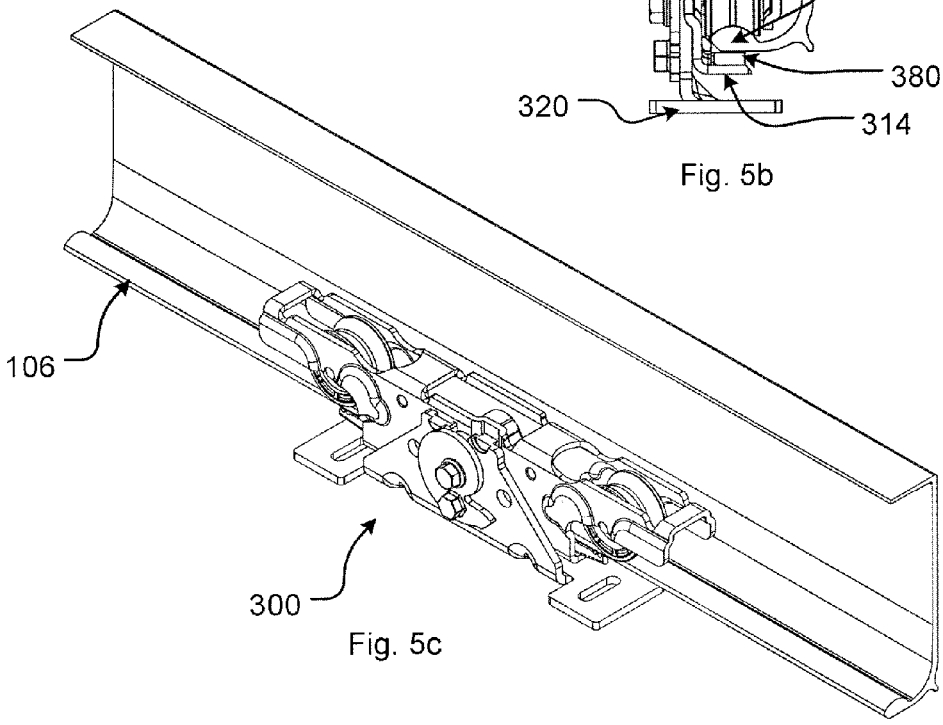

FIGS. 5*a-c* illustrates the wheel carriage 300 positioned in a sliding track 106. The wheels 330 rests on the track 106 and the weight of the door panel 101 is carried by the sliding track 106. The wheel holder 310 is positioned around the sliding track 106. The sliding track runs in the opening 318 of the C-shape of the wheel holder. The lower side 314 of the wheel holder 310 is positioned under the sliding track. The wheel holder 310 is attached to the door carrier 320. The horisontal part of the door carrier 320 runs under the sliding track 106, in parallell with the sliding track 106. An antiriser 380 prevents the wheel carriage from running off the track, when the wheel carriage 300 runs in the track. The antiriser 380 is removed before replacing the wheels 330.

Figure 5D:
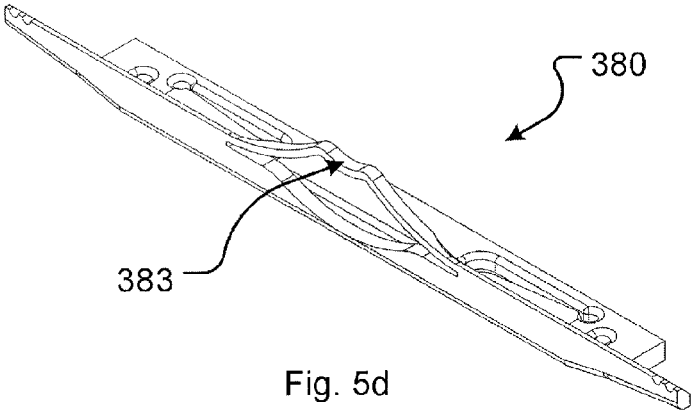
FIGS. 5*d-f* illustrates an antiriser
Figure 5E:
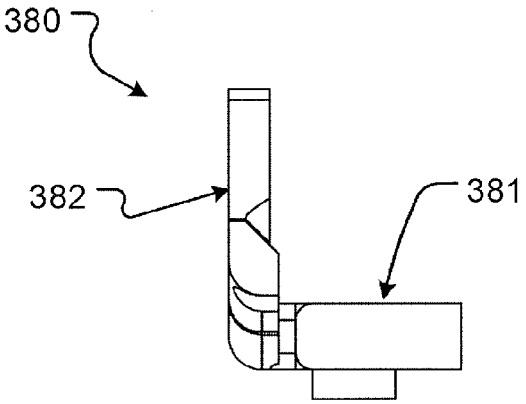

FIGS. 5*d* shows the antiriser 380 in more detail. The antiriser 380 is made from a metal sheet bent into an L-shape. FIG. 5*e* shows the antiriser when seen from the side. The horisontal part 381 of the L-shape 381 comprises connection means for connecting the antiriser to the wheel holder 310. The vertical part 382 is placed in the opening 318 of the wheel holder 310, when the anti riser is attached to the wheel holder 310.

Figure 5F:
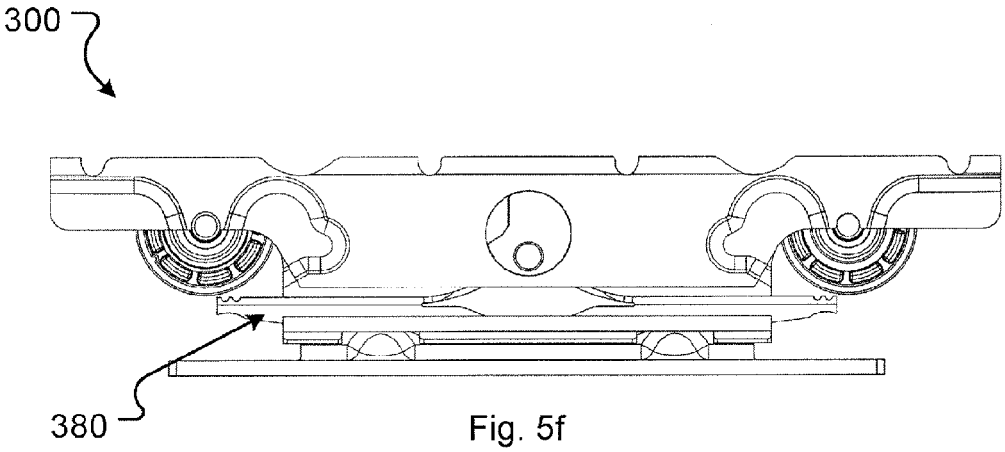

The vertical part 382 of the antiriser 380 comprises a lip-shaped part 383, which is adapted to rest againt the centre shaft 360, when mounted. FIG. 5*f* shows the antiriser 380 mounted in the wheel carriage 300, seen from the backside, i.e. the side facing the sliding track 106. The vertical part 382 then fills the opening 318 such that the wheel carriage 300 cannot be removed from the track 106, without removing the antiriser 380.

Figure 6A:
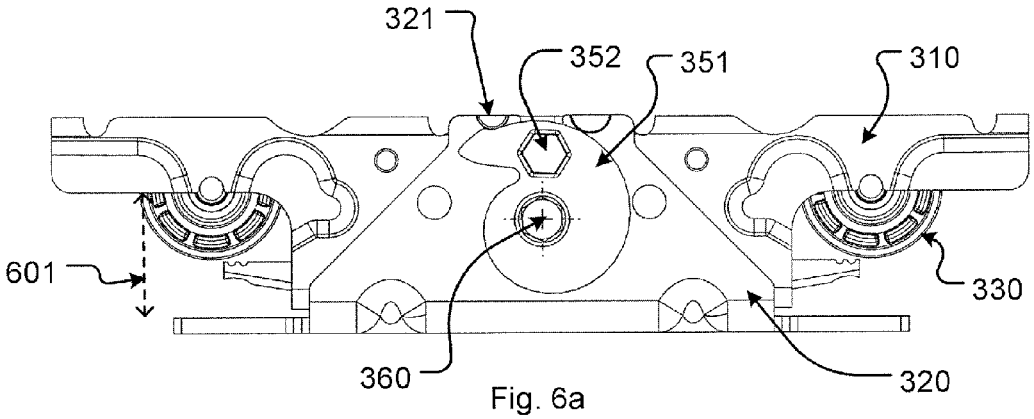
FIGS. 6*a-c* illustrates height adjustment of a sliding door.
Figure 6B:
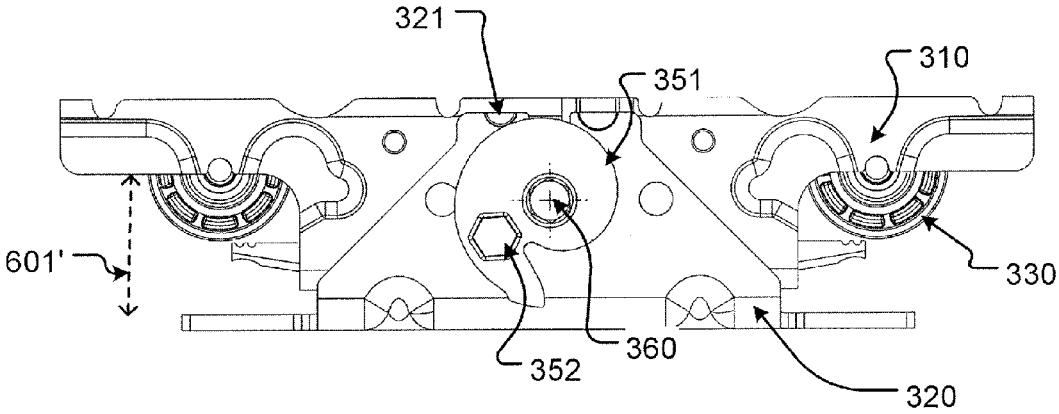
Figure 6C:
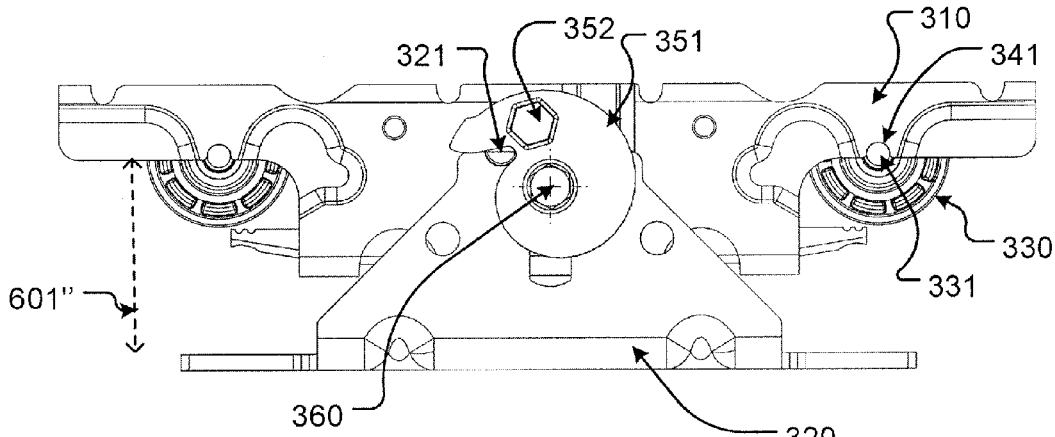

FIGS. 6*a-c* illustrates height adjustment of a sliding door resting in a sliding track. In FIG. 6*a* the door panel is in the highest position, i.e. the distance 601 between the door carrier and the wheel carrier is as small as possible. First, the fixation screw 370 needs to be loosened. When the fixation screw 370 is loosened, the door can be height adjusted. This is done by putting a tool at the key grip 352 and rotating the excenter cam disc 351 in a counterclockwise direction. The key grip 352 is equal to the grip of the fixation screw 370. Thereby the same tool can be used. When the excenter cam disc is rotated around the axis 301 (see FIG. 3*b*), the distance between the fixation screw 370 and the knob 322 changes, due to the excenter cam curve. As the fixation screw 370 is fixed in relation to the wheel holder 310 and the knob 321 is rotatably fixed to the door carrier, when the fixation screw is loosened, the distance between the wheel holder and the door carrier 601 will also change in the same manner. Thereby, the height of the door panel 101 is adjusted. In FIG. 6*b* the excenter rotation has started and the distance 601' has increased. In FIG. 6*c* the knob is at the end of the cam curve, i.e. the distance 601" between the door carrier 320 and the wheel holder 310 is maximal. Hence, the door panel 101 is in its lowest position.

Figure 7A:
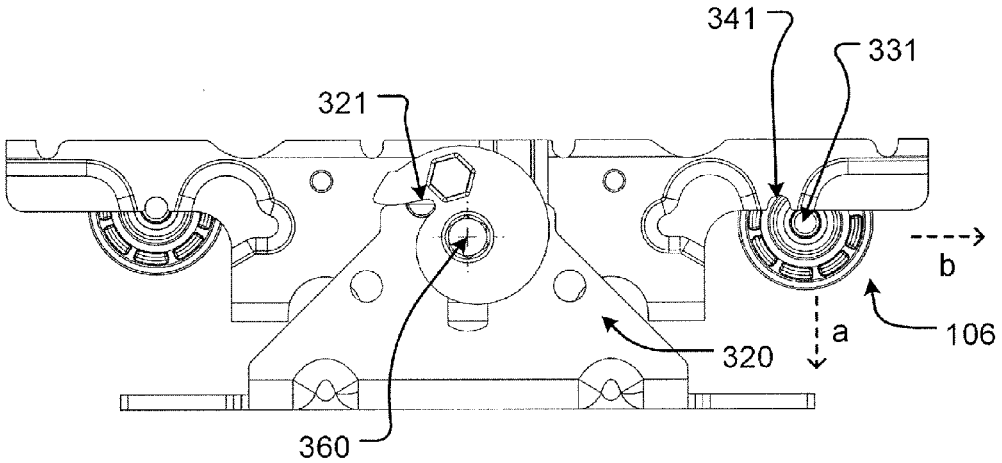
FIGS. 7*a-b* illustrates removing a wheel from a wheel carriage resting in a sliding track.
Figure 7B:
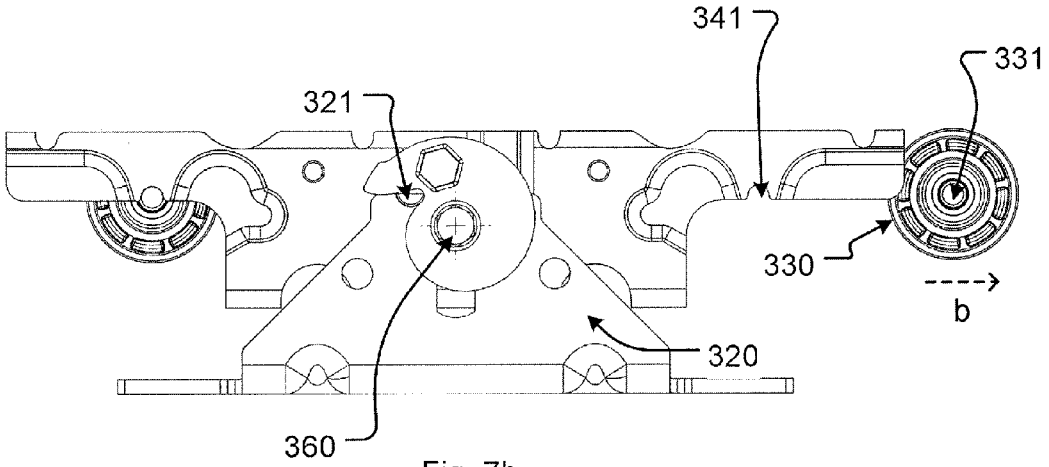

FIGS. 7*a-b* illustrates how to remove a wheel 330 of the wheel carriage 300 resting in a sliding track. As previously disclosed in FIG. 6*c* the door panel 101 is lowered such that it rests on the foundation. The gravitation force of the door panel 101 holding or attaching the wheels is then removed. Hence, the only force holding the wheels is then the gravitation force of the wheel holder 310. As the wheel shaft 331 is fixed in the recesses 331 by the gravitation force, this implies that the wheels 330 can now be easily removed. This is done by lifting the wheel holder slightly, such that the wheel shaft can be removed from the recess 341. The wheel 330 is then removed from the recesses by directing the wheels in direction a. When the wheel shaft is removed from the recesses 341, the wheel 330 can be directed towards and through the short side 313 of the wheel holder 310, in direction b. The tapering parts 316 of the wheel holder 310, provides space for the wheel shafts 331 when directing the wheel 330 towards the short side 313. When the wheel 330 is removed from the wheel holder 310, a new wheel may be inserted in the same manner by directing a wheel through the short side 313 towards the recesses 341. The wheel is then attached by directing the wheel shaft 331 into the recesses 341. Finally, the wheel 330 is fixated by elevating the door panel 101 to such an extent that the weight of the door panels 101 rests on the wheels 330. This is done by rotating the excenter cam disc 351 in a clockwise direction. When requested height is achieved, the fixation screw is tightened such that the door carrier 320, the excenter cam disc 351 and the wheel holder 310 are held in a fixed position.

Height adjustment for exchanging wheels of the wheel carraige may be done using other height adjustment means. The height adjustment means may be within the wheel carriage or at other position e.g. at the door blade. The door may also be lifted by a dumbcraft.

Figure 8:
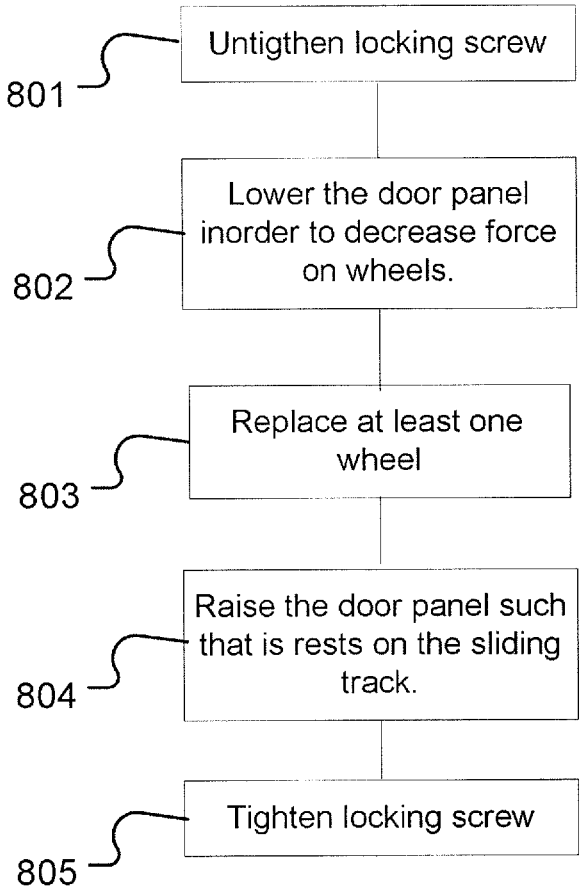
FIG. 8 discloses a method for replacing the wheels of a sliding door carrier.

FIG. 8 discloses the method for exchanging the wheels 330 in a wheel carriage 330 in a flowchart. In the first step 801, the fixation screw 370 is untightened. The wheel holder 310 is then slidable in relation to the door carrier 320. The wheels are mainly held in place by the weight of the wheel carriage 300. In the next step 802, the door panel 101 is lowered until the weight of the door panel 101 rests on the foundation 105. This is done by rotating the excenter cam disc 351 around the axis 301 in a counterclockwise direction. The gravitation force holding the wheels 330 in place is now removed, which implies that the wheels are loose.

In step 803 the wheels are removed. This is done by lifting the wheel carriage 300, and removing the wheels 330 through the short side 313 of the wheel carriage 300, see FIG. 7*a*-7*b*. Then wheels are then inserted through the short side 313 and positioned in the recesses 341. The same procedure may be performed for one or several wheels. When the wheel or wheels 330 are replaced, the door panel 101 is elevated to a desired position, step 804. The door panel 101 is elevated at least to such an extent that it rests in the sliding track 106. The wheels 330 are then fastened or held in place by the gravitation force of the door panel 101. Finally, the locking screw 307 is tightened as disclosed in step 805.

The foregoing has described the principles, preferred embodiments and modes of operation of the present invention. However, the description should be regarded as illustrative rather than restrictive, and the invention should not be limited to the particular embodiments discussed above. The different features of the various embodiments of the invention can be combined in other combinations than those explicitly described. It should therefore be appreciated that variations may be made in those embodiments by those skilled in the art without departing from the scope of the present invention as defined by the following claims.

The invention claimed is:

1. A wheel carriage, comprising:

a wheel holder comprising a horizontally oriented upper side having a first edge and a second edge spaced from the first edge, a horizontally oriented lower side spaced from the upper side and having a first edge and a second edge spaced from the first edge, a first vertically oriented side extending between the first edge of the upper side and the first edge of the lower side, and a second vertically oriented side extending from the second edge of the upper side and spaced from the first vertically oriented side, the first vertically oriented side, the upper side and the lower side configured to surround three sides of a horizontally oriented sliding track, and at least two wheel connections, each wheel connection comprising a recess in a lower edge of the first and second vertically oriented sides of the wheel holder, wherein each recess is adapted to receive a wheel shaft, and that the wheel carriage further comprises;

a door carrier, movably connected to the wheel holder and adapted to be attached to the upper part of a door panel of a sliding door;

height adjustment means movable between a first position and a second position, wherein in the second position the height adjustment means is configured to position the sliding door on a foundation and to allow removal of wheels from the wheel holder when the wheel carriage is arranged in a sliding track, wherein in the first position the height adjustment means is configured to create a gap in a vertical direction between the sliding door and the foundation when the wheel carriage is arranged in the sliding track, and wherein the height adjustment means is configured to vary the size of the gap between the first and second position; and an antiriser removably mounted to the lower side of the wheel holder, at least a portion of the antiriser positioned above the lower side of the wheel holder and configured to be below the sliding track and to prevent the wheel carriage from running off the sliding track when mounted to the lower side of the wheel holder.

2. A wheel carriage according to claim 1, wherein the height adjustment means comprises an excenter cam disk rotatable around an axis running through the wheel holder, and wherein the excenter cam disk is in contact with the door carrier, such that rotation of the excenter cam disk varies the distance between the wheel holder and the door carrier.

3. A wheel carriage according to claim 1, further comprising two wheels and each wheel comprising a wheel shaft, wherein the wheel shafts are fixed in the recesses of the wheel holder by only the gravitation force of the wheel carriage.

4. A wheel carriage according to claim 1, wherein the lower side has a first end and a second end, and wherein the first and second vertically oriented sides and the upper side extend beyond the first end and second end of the lower side to form an open configuration at each end of the wheel holder such that a wheel and associated wheel shaft may be removed through the open configuration when the wheel carriage is positioned in the sliding track.

5. A wheel carriage according to claim 1, wherein the wheel holder has a boxlike shape.

6. A wheel carriage according to claim 2, wherein the excenter cam disk comprises a first key grip.

7. A wheel carriage according to claim 6 further comprising:

a fixation screw adapted to fixate the door in a vertical position, wherein the fixation screw comprises a second key grip, wherein the second key grip is substantially equal in size to the first key grip whereby the same tool may be used to adjust both the first and second key grip.

8. A wheel carriage for a sliding door resting in a sliding track, comprising:

a wheel holder comprising a horizontally oriented upper side having a first edge and a second edge spaced from the first edge, a horizontally oriented lower side spaced from the upper side and having a first edge and a second edge spaced from the first edge, a first vertically oriented side extending between the first edge of the upper side and the first edge of the lower side, and a second vertically oriented side extending from the second edge of the upper side and spaced from the first vertically oriented side, the first vertically oriented side, the upper side and the lower side configured to surround three sides of a horizontally oriented sliding track, and at least two wheel connections, each wheel connection comprising two recesses in a lower edge of the first and second vertically oriented sides of the wheel holder;

two wheels, each comprising a wheel shaft, the wheel shaft having opposed ends, wherein each recess receives one end of one of the wheel shafts;

a door carrier, movably connected to the wheel holder and adapted to be attached to the upper part of a door panel;

height adjustment means movable between a first position and a second position, wherein in the second position the height adjustment means positions the sliding door on a foundation and the wheels are removable from the wheel holder when the wheel carriage is positioned in the sliding track, wherein in the first position the height adjustment means creates a gap in a vertical direction between the sliding door and the foundation when the wheel carriage is in the sliding track, and wherein the height adjustment means is configured to vary the size of the gap between the first and second position, and an antiriser comprising a first portion removably mounted to the lower side of the wheel holder, and a second portion extending perpendicular to the first portion, wherein the first and second portions are disposed above the lower side of the wheel holder and configured to be below the sliding track and to prevent the wheel carriage from running off the sliding track.

9. A wheel carriage according to claim 8, wherein the lower side has a first end and a second end, and wherein the first and second vertically oriented sides and the upper side extend beyond the first end and second end of the lower side to form an open configuration at each end of the wheel holder such that a wheel and wheel shaft is removable through the open configuration when the wheel carriage is positioned in the sliding track.

10. A wheel carriage according to claim 8, wherein the wheel shafts are seated in the recesses of the wheel holder by only the gravitation force of the wheel carriage when the wheel carriage is positioned in the sliding track.

11. A wheel carriage according to claim 8, wherein the height adjustment means comprises an excenter cam disk rotatable around an axis running through the wheel holder, and wherein the excenter cam disk is in contact with the door carrier, such that rotation of the excenter cam disk varies the distance between the wheel holder and the door carrier.

12. The wheel carriage according to claim 8, wherein the height adjustment means further comprises a height adjustment shaft rotatably coupled with the door carrier and the wheel holder, and wherein the antiriser comprises a third portion extending from the second portion, and wherein the first portion of the antiriser engages the lower side of the wheel holder and the third portion engages the height adjustment shaft.

13. In combination, a wheel carriage and sliding door, comprising:

a wheel carriage having a horizontally oriented upper side having a first edge and a second edge spaced from the first edge, a horizontally oriented lower side spaced from the upper side and having a first edge and a second edge spaced from the first edge, a first vertically oriented side extending between the first edge of the upper side and the first edge of the lower side, and a second vertically oriented side extending from the second edge of the upper side and spaced from the first vertically oriented side, the first vertically oriented side, the upper side and the lower side configured to surround a horizontally oriented sliding track, and at least two wheel connections, each wheel connection comprises two recesses in a lower edge of the first and second vertically oriented sides of the wheel holder;

two wheels, each comprising a wheel shaft, the wheel shaft having opposed ends, wherein each recess receives one end of one of the wheel shafts;

a door carrier, movably connected to the wheel holder and attached to an upper part of the sliding door, the door extending below the wheel holder;

height adjustment means movable between a first position and a second position, wherein in the second position the height adjustment means positions the sliding door on a foundation and the wheels are removable from the wheel holder when the wheel carriage is positioned in the sliding track, wherein in the first position the height adjustment means creates a gap in a vertical direction between the sliding door and the foundation when the wheel carriage is in the sliding track, and wherein the height adjustment means is configured to vary the size of the gap between the first and second position; and an antiriser removably mounted to the lower side of the wheel holder, at least a portion of the antiriser positioned above the lower side of the wheel holder and configured to be below the sliding track and to prevent the wheel carriage from running off the sliding track when mounted to the lower side of the wheel holder.

* * * * *